US006145902A

United States Patent [19]

Miyagishima

[11] Patent Number: 6,145,902

[45] Date of Patent: Nov. 14, 2000

[54] MAGNET POSITIONING APPARATUS FOR POSITIONING A MAGNET INTO A SUBSURFACE REGION

[75] Inventor: Yoshimasa Miyagishima, Gardena, Calif.

[73] Assignee: Honda Giken Kogyo Kabushiki Kaisha, Tokyo, Japan

[21] Appl. No.: 09/422,275

[22] Filed: Oct. 21, 1999

Related U.S. Application Data

[62] Division of application No. 09/009,190, Jan. 20, 1998, Pat. No. 5,992,911.

[51] Int. Cl.[7] ..... B66C 1/04

[52] U.S. Cl. ..... 294/65.5; 294/1.1

[58] Field of Search ..... 294/1.1, 65.5, 294/86.1; 404/9, 12–16, 26, 93, 94; 335/285, 287, 289–294; 81/125; 221/212

[56] References Cited

U.S. PATENT DOCUMENTS

| | | | |
|---|---|---|---|
| 2,417,762 | 3/1947 | Koller | 294/65.5 |
| 3,182,838 | 5/1965 | Brandenbusch | 294/65.5 |
| 3,771,084 | 11/1973 | Thon | 294/65.5 |
| 4,084,821 | 4/1978 | Vidnovic | 294/65.5 |
| 4,554,703 | 11/1985 | Matuki | 294/65.5 |
| 4,620,739 | 11/1986 | Coralline | 294/65.5 |
| 4,943,098 | 7/1990 | Aoyama | 294/65.5 |

*Primary Examiner*—Dean J. Kramer

*Attorney, Agent, or Firm*—Armstrong, Westerman, Hattori, McLeland & Naughton

[57] ABSTRACT

A magnet positioning apparatus is provided for positioning a magnet or magnets through a hole in a surface, such as a road surface, a cabinet surface or a curved surface, and into a subsurface region therein. The magnet positioning apparatus includes a main body portion made of a non-magnetic material. The main body portion may be any shape, a hollow cylindrically shaped or plate-/block-shaped with a lower surface shape complementarily corresponding to the shape of a flat or curved surface in which the magnet is to be positioned. If the main body portion is a hollow cylindrical member, the outer periphery of the hollow cylindrical member includes a plurality of arms extending radially outwardly therefrom. In a case where there are three arms, two of the arms may extend outwardly rectilinearly with the third arm extending perpendicularly outwardly from the other two arms. At the outer end of the plurality of arms is a widened portion, and any of the plurality of arms ends in an adjustment member having a threaded hole perpendicularly therethrough which mates with a screw having a rod-shaped portion attached on the head thereof for allowing one full rotation of the screw to adjust the predetermined angle of the magnet positioning apparatus. The magnet positioning apparatus also includes a member for releasably securing a magnet to the main body portion wherein the member is either made of magnetic material or is an electromagnet. The releasably securing member may also include a grasping portion which is scored or roughened and may slidingly nest within the inner diameter of the hollow cylindrical member.

7 Claims, 6 Drawing Sheets

MAGNET POSITIONING APPARATUS FOR POSITIONING A MAGNET INTO A SUBSURFACE REGION

This application is a division of prior application Ser. No. 09/009,190 filed Jan. 20, 1998 now U.S. Pat. No. 5,992,911.

FIELD OF THE INVENTION

The present invention generally relates to a magnet positioning apparatus and more particularly, to a magnet positioning apparatus for precisely positioning a magnet through a hole in a surface and into a subsurface region thereof so that a top surface of the magnet is at a predetermined angle to and a predetermined height from the surface adjacent to the hole in which the magnet is positioned.

BACKGROUND OF THE INVENTION

The positioning of a magnet or magnets through a hole in a surface and into a subsurface region can be a difficult and often time consuming task if it is necessary to position the magnet with some degree of accuracy. Conventionally, magnets have often been positioned into subsurface regions by hand since few devices have previously been known for use in accurately positioning a magnet or magnets through a hole into a subsurface region. In positioning of a magnet by hand, the precision and the accuracy of the position of the magnet cannot be ensured. Therefore, an object of the present invention is to provide a magnet positioning apparatus which is simple in design and construction, yet which allows quick, easy and precise positioning a magnet or magnets through a hole in a surface and into a subsurface region thereof so that a top surface of the magnet is at a predetermined angle to and a predetermined distance from that portion of the surface which is adjacent to the hole in which the magnet is to be positioned.

Accurate magnet positioning is of concern, for example, in the field of cabinets where the cabinet hardware is held to the outer surface of the cabinet via a magnet embedded beneath the outer surface of the cabinet.

Intelligent vehicle highway systems is another field where the accurate positioning of a magnet or magnets is required. An objective of intelligent vehicle highway systems is to produce a combination of vehicles and highways which are highly automated so that the vehicle and the highway cooperate to perform more of the driving tasks which are now performed by the human being driving the vehicle. More particularly, one facet of intelligent vehicle highway systems is to allow the highway and the vehicle to do the steering of the vehicle. One way of accomplishing allowing the highway and the vehicle to steer the vehicle involves the use of a magnet or magnets which have been positioned through holes drilled in a road surface and into subsurface regions beneath the surface of the roadway. The magnet is positioned through the hole in the road surface and into the subsurface region so that a magnet is located at predetermined intervals from an adjacent magnet and so as to be at the center of a lane of a roadway. In this way, a vehicle having magnetometers mounted on a front end thereof may be steered by detecting a magnetic field from the magnet or magnets positioned through the hole in the road surface and into the subsurface region beneath the road surface in the center of a lane of the roadway.

Thus, the problem of precisely positioning a magnet or magnets through a hole in a road surface and into a subsurface region beneath the road surface requires that the magnet or magnets be positioned through the hole in the road surface and into the subsurface region therebeneath so that a top surface of the magnet is at a predetermined angle to and a predetermined distance from the road surface adjacent to the hole for proper detection of the magnetic field generated by the magnet or magnets in order to be able to drive the vehicle straight without any yaw or swaying. Conventional means of positioning such magnets are time consuming and not always accurate. Therefore, it is desirable to provide a magnet positioning apparatus which is of simple construction and which can easily, quickly and precisely position at least one magnet through a hole in a surface and into a subsurface region therebelow so that the top surface of the magnet is at a predetermined angle to and a predetermined distance from the surface adjacent to the hole in which the magnet is positioned for proper detection of the magnetic field generated by the magnet or magnets.

SUMMARY OF THE INVENTION

The present invention provides a magnet positioning apparatus for precisely positioning a magnet or magnets through a hole in a surface and into a subsurface region so that the top surface of the magnet is at a predetermined angle to and a predetermined distance from the area of the surface which is immediately adjacent to the hole in which the magnet is to be positioned. The magnet positioning apparatus includes a main body portion of a non-magnetic material and a member for releasably securing the magnet to the main body portion. The member for releasably securing the magnet to the main body portion is made of a magnetic material. Alternatively, the member for releasably securing the magnet to the main body portion may be an electromagnet having a switch, such as a double-pole, double-throw switch for easily changing the polarity of the electromagnet and a battery. The magnet positioning apparatus also includes an adjustment member for fine tuning the angle and the height of the main body portion relative to the surface.

The present invention has the advantages that it provides a magnet positioning apparatus which is simple and economical in construction, but which quickly, easily and accurately positions a magnet or magnets through a hole in a surface and into a subsurface region so that the upper surface of the magnet is at a predetermined angle to and predetermined distance from the surface surrounding the hole.

BRIEF EXPLANATION OF THE DRAWING FIGURES

DETAILED DESCRIPTION OF THE INVENTION

Figure 13:
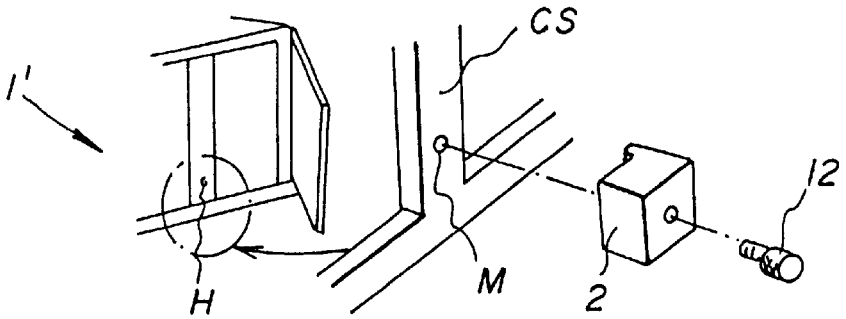
FIG. 13 is a perspective view of a fourth embodiment of the magnet positioning apparatus for positioning a magnet through a hole in a cabinet surface.
Figure 14:
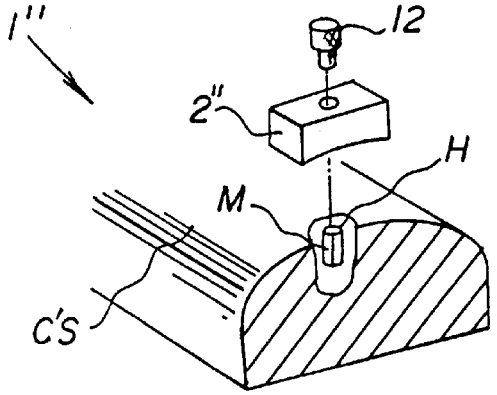
FIG. 14 is a perspective view a fifth embodiment of the magnet positioning apparatus for positioning a magnet through a hole in a curved surface.

The magnet positioning apparatus 1 of the present invention will now be described in detail with reference to the accompanying drawing figures. FIGS. 1–12 illustrate first and second embodiments of a magnet positioning apparatus 1 and variations thereof for use in positioning a magnet (or magnets) through a hole in a road surface and into a subsurface region therebelow. FIG. 13 illustrates a magnet positioning apparatus 1' for use in positioning a magnet beneath the surface of a cabinet, for example, a door, drawer, etc., in order for the magnet to be used in securing the hardware to the cabinet and for keeping the cabinet in a closed state. FIG. 14 illustrates a magnet positioning apparatus 1" for positioning a magnet through a hole in a curved surface and into a subsurface region therebelow. Although only three specific uses for the magnet positioning apparatus of the present invention will be described herein, it is to be understood that many other uses of the magnet positioning apparatus of the present invention are possible and the invention is not limited to the uses described.

Figure 1:
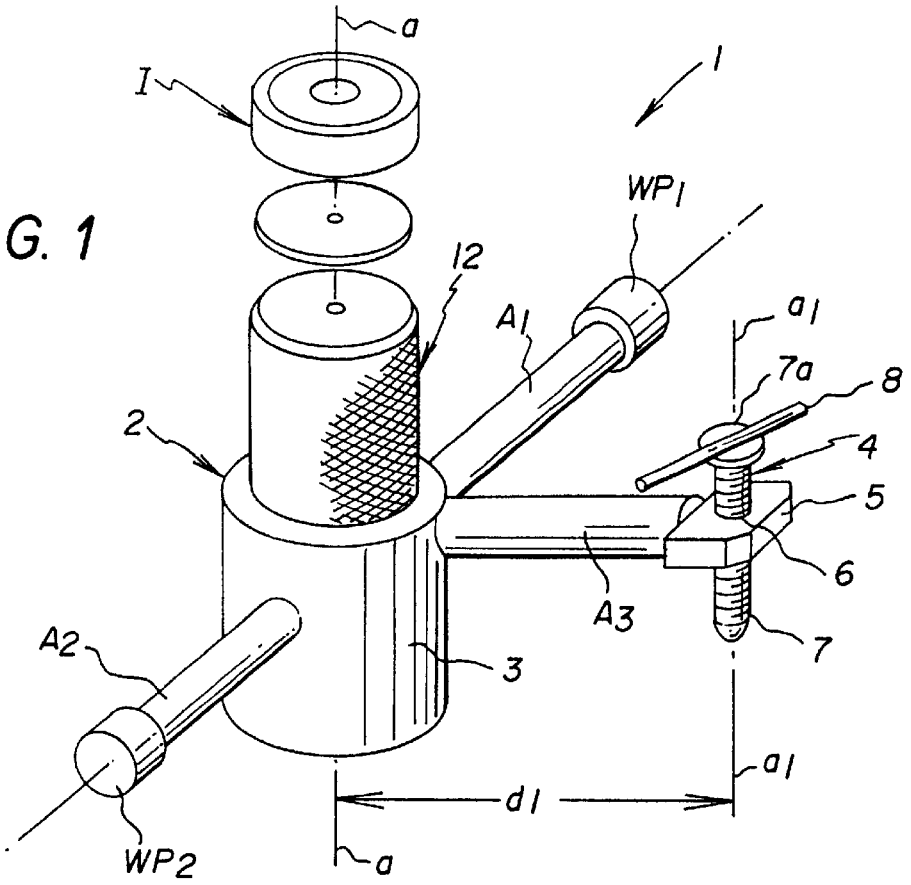
FIG. 1 is a perspective view of a first embodiment of the magnet positioning apparatus of the present invention.

Referring to FIG. 1, the magnet positioning apparatus 1 of the present invention is shown for use in precisely positioning a magnet M (or magnets $M_1$–$M_n$) through a hole H (as seen in FIGS. 7–10) which has been drilled into a road surface RS so that the upper surface $M_{us}$ of the magnet M is at a predetermined angle θ (most likely parallel to the upper surface, but not always) and a predetermined distance d in relation to the portion of the road surface RS that is closely adjacent to the hole H into which the magnet M is positioned.

Figure 11:
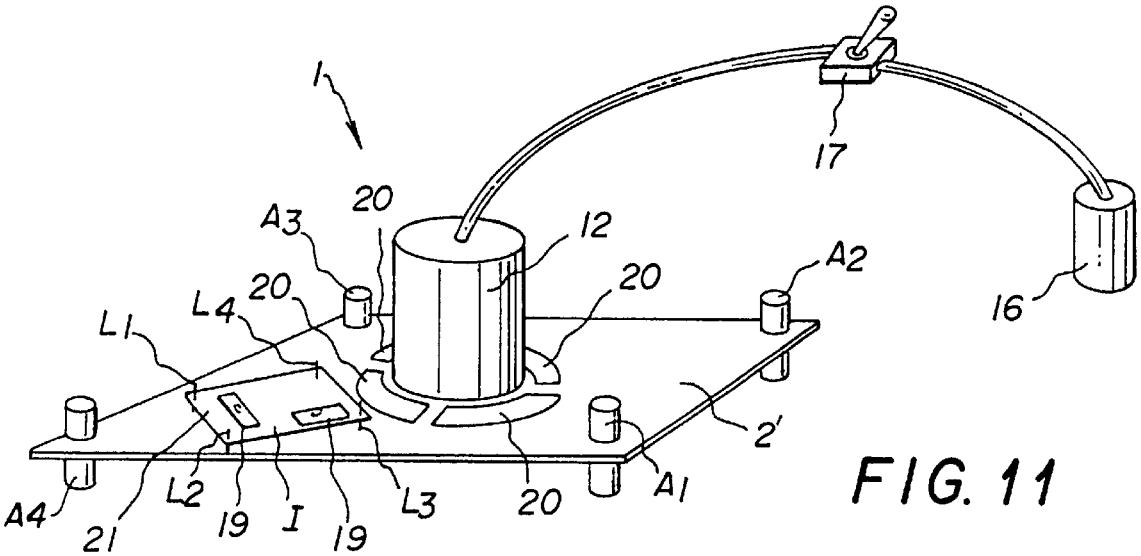
FIG. 11 is a perspective view of a second embodiment of the magnet positioning apparatus of the present invention theoretically illustrating all necessary components in a generalized layout, but is not necessarily a working model.

The magnet positioning apparatus 1 includes a main body portion 2 made up of a hollow cylindrical member 3 and a plurality of arms $A_1$–$A_n$. Although the first embodiment of the magnet positioning apparatus 1 of the present invention has a main body portion 2 which includes a hollow cylindrical member 3, it should be noted that the main body portion 2 may be of any shape and configuration necessary to perform the function of securing a magnet M thereto for positioning of the magnet M through the hole H and into a subsurface region below the road surface RS. Indeed, FIG. 11 shows a plate-shaped main body portion 2' and FIG. 14 shows a main body portion 2" having a lower curved surface which corresponds in shape to the curved surface of the substrate.

The main body portion 2 is made of a material that is non-magnetic such as aluminum, stainless steel, plastic, wood, etc.

The hollow cylindrical member 3 has an outer periphery and an inner periphery which correspond to an outer diameter and an inner diameter, respectively. The outer periphery of the hollow cylindrical member 3 has first ends of a plurality of arms $A_1$–$A_n$ attached thereto and the plurality of arms $A_1$–$A_n$ extend generally radially outwardly therefrom.

In a first embodiment of the magnet positioning apparatus 1 as shown in FIG. 1, the main body portion 2 has three arms $A_1$–$A_3$ wherein a first arm $A_1$ and a second arm $A_2$ extend rectilinearly outwardly from the hollow cylindrical member 3 and a third arm $A_3$ extends outwardly from the hollow cylindrical member 3 so as to be perpendicular to the other two arms $A_1$, $A_2$.

Figure 2:
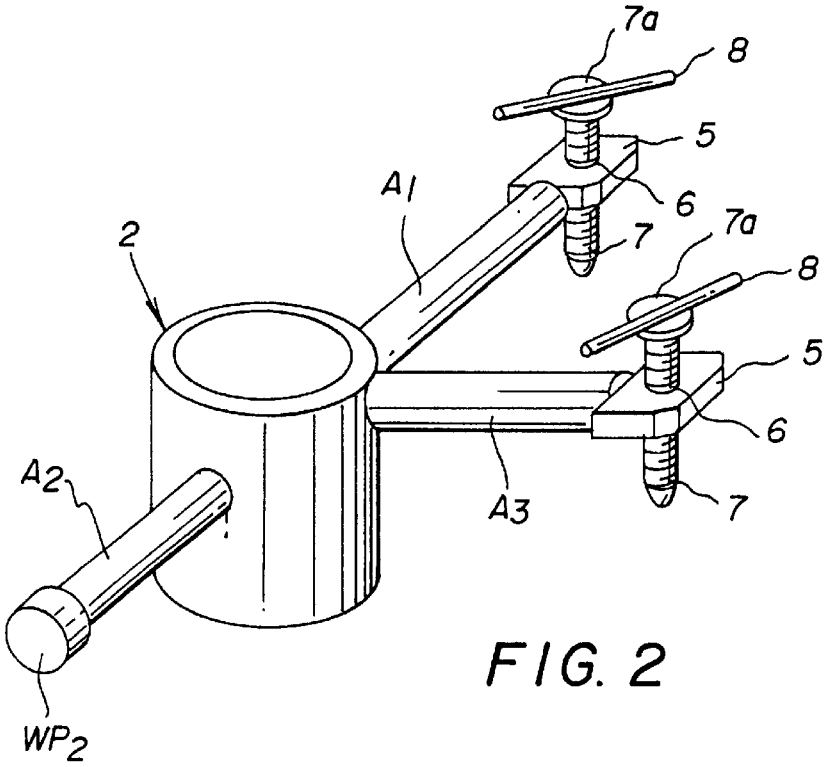
FIG. 2 is a perspective view of the main body portion of the first embodiment of the magnet positioning apparatus of FIG. 1 showing a variation in the number of adjustment members.

Each of the three arms $A_1$–$A_3$ extending outwardly from the hollow cylindrical member 3 of the main body portion 2 of the first embodiment of the magnet positioning apparatus 1 has a second end (i.e., the end furthest away from the outer periphery of the hollow cylindrical member 3) which may include a widened portion WP. However, as shown in FIG. 1, one of the plurality of arms $A_1$–$A_n$ (in this case, the third arm $A_3$) may have an adjustment member 4 on the second end of the arm $A_3$. Alternatively, as shown in FIG. 2, two of the arms (i.e., the first arm $A_1$ and the third arm $A_3$) may have second ends to which adjustment members 4 are connected. The dimension from the bottom surface (where the magnet M is held) of the hollow cylindrical member 3 to the lowest part of the widened portion WP or the lowest portion of the screw 7 determines the height H of the upper surface of the magnet M.

The adjustment member 4 includes a plate-like member 5 having a threaded hole 6 perpendicularly therethrough. A screw 7 matingly fits in the threaded hole 6 in order to be rotated therein enabling the arm $A_3$ to move in the axial direction of the screw 7. It should be noted that the central longitudinal axis a of the magnet positioning apparatus 1 and the central longitudinal axis $a_1$ of the screw 7 and threaded hole 6 of the adjustment member are parallel to each other and have a predetermined distance d1 therebetween so that a predetermined amount of rotation of the screw 7 corresponds to a fixed amount of angular variation of the angle θ between the upper surface $M_{us}$ of the magnet M and the road surface RS adjacent to the hole H in which the magnet M is to be positioned, so that a fine adjustment for setting the predetermined angle θ can be performed accurately.

The screw 7 has a head 7*a* to which a rod-shaped member 8 may be welded or otherwise connected in order for easy visual reference that the screw 7 has been turned through one full rotation or fractions thereof corresponding to a fixed amount of angular variation of the angle θ.

Figure 5:
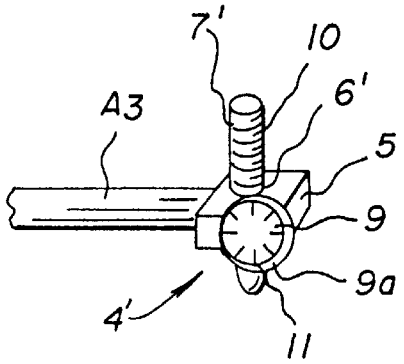
FIG. 5 is a perspective view of a variation of the adjustment member of FIGS. 1, 2, and 4 of the first embodiment of the magnet positioning apparatus.

Alternatively, the screw 7 with the rod-shaped member 8 attached to the head 7*a* thereof may be replaced by a different arrangement for an adjustment member 4' as shown in FIG. 5. Referring to FIG. 5, a variation of the adjustment member 4' of the first embodiment of the magnet positioning apparatus 1 of the present invention is shown wherein a third arm $A_3$ of the main body portion 2 includes a graduated post 7' through a hole 6' in a plate-like member 5 connected to a second end thereof and an adjustment screw 9 through a hole in the side of the plate-like member 5. The graduated post 7' has graduations 10 thereon corresponding to graduations 11 on the head 9*a* of the adjustment screw 9 so that similarly to the previously described arrangement of the adjustment member 4, one turn of the adjustment screw through one graduation raises or lowers the graduated post 7' by one graduation to cause a fixed amount of angular variation. In cases where less accuracy is required, the adjustment member 4 is not necessary and thus, rather than providing an adjustment member 4, the apparatus is instead simply provided with a widened portion WP on the end of each of the arms $A_1$–$A_n$.

Figure 3:
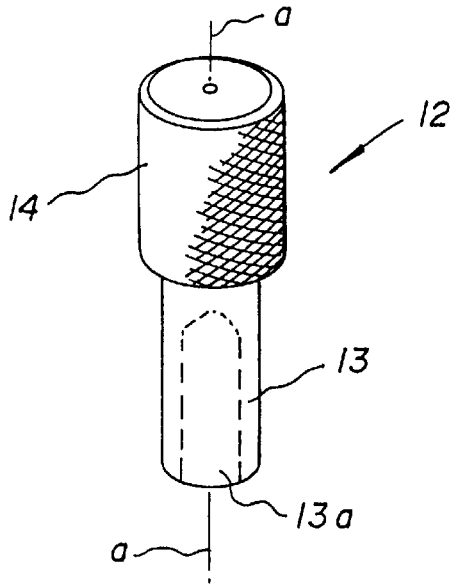
FIG. 3 is a perspective view of a magnet holding member of the first embodiment of the magnet positioning apparatus shown in FIG. 1.

The first embodiment of the magnet positioning apparatus 1 of the present invention as shown in FIG. 1 also includes a member 12 for releasably securing the magnet M to the main body portion 2. Referring to FIG. 3, the member 12 for releasably securing the magnet M from the main body portion 2 is shown removed from its nested position in the hollow cylindrical member 3 of the main body portion 2 of the magnet positioning apparatus 1. The member 12 for releasably securing the magnet M to the main body portion 2 holds the magnet M against the bottom surface of the hollow cylindrical member 3 of the main body portion 2.

The member 12 for releasably securing the magnet M to the main body portion 2 has a first cylindrical member being a magnetic portion 13 and a second cylindrical portion being a grasping portion 14. The magnetic portion 13 has an outer diameter which is slightly smaller than the inner diameter of the hollow cylindrical member 3 of the main body portion 2 so that the magnetic portion 13 can be slidingly positioned within the hollow cylindrical member 3 in order to draw a magnet M to rest against the lower surface of the hollow cylindrical member 3. It should be noted that the magnetic portion 13 need not actually come into contact with the magnet M in order to hold the magnet M in place against the bottom surface of the hollow cylindrical member 3, but rather the magnetic attractive force between the magnet M and the magnetic portion 13 is adjusted by having a gap of a different size therebetween. The magnetic portion 13 only needs to be close enough to the magnet M so that the magnet M will be drawn against the lower surface of the hollow cylindrical member 3 to hold the magnet M in place. Also, the magnetic portion 13 may have a bore 13*a* drilled through a lower surface thereof to further decrease the magnetic attractive force to the level comfortable to the user to release the magnetic portion 13 from the magnet M.

The grasping portion 14 of the member 12 for releasably securing the magnet M to the main body portion 2 has an outer diameter that is larger than the inner diameter of the hollow cylindrical member 3 so that the sliding insertion of the magnetic member 13 within the hollow cylindrical member 3 is stopped when the lower surface of the grasping portion 14 contacts the upper surface of the hollow cylindrical member 3. The grasping portion 14 has an outer periphery which is scored or slightly roughened for surer gripping of the grasping portion 14. The grasping portion 14 is grasped and pulled in a direction away from the upper surface of the hollow cylindrical member 3 in order to withdraw the magnetic portion 13 from its nested position within the hollow cylindrical member 3 so as to release the magnet M or magnets $M_1$–$M_n$ from contact with the bottom wall of the hollow cylindrical member 3.

Referring to FIG. 1, an angle indicator I, such as a commercially available bullseye level is shown which may be connected to the upper surface of the grasping portion 14 by any conventional means. Different types or styles of commercially available levels may be used on the magnet positioning apparatus 1 for road surface RS where the magnet M is being accurately positioned in an inclined, declined or curved road segment or where the roadway is flat or has a crown. In the cases where less accuracy is required, the angle indicator I is not necessary.

Figure 4:
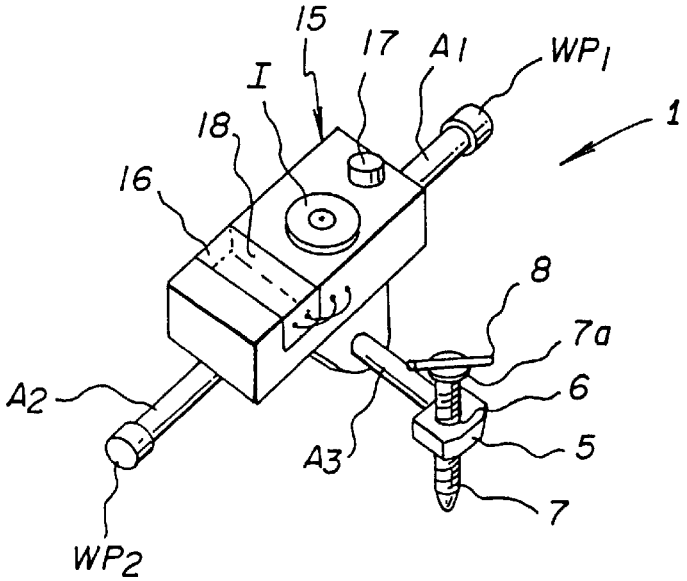
FIG. 4 is a perspective view of a variation of the magnet holding member of the first embodiment of the magnet positioning apparatus of FIG. 1 showing an electromagnet in place of the magnet holding member of FIG. 3.

Referring to FIG. 4, a variation of using member 12 for releasably securing the magnet M to the main body portion 2 is illustrated by reference numeral 15. Thus, an electromagnet 15 may be substituted for the member 12 for releasably securing the magnet M to the main body portion 2. Indeed, an electromagnet 15 is advantageous in that the on/off capability of the electromagnet 15 can be controlled by remote control and the polarity of the electromagnet can be easily changed by reversing current flow with the use of a double-pole, double-throw switch. Furthermore, where magnets in the road surface are coded (for example, having all of the north poles of the magnets in a curve facing upwardly and all the south poles of the magnets in a straight-away facing upwardly), the coding can be done by selecting the polarity of the electromagnet, thus selecting proper polarity of the upwardly facing magnet M. In this way, obstructions or other structures coming up in roadway can also be coded.

The electromagnet 15 includes a battery 16 and a switch 17 which acts to close a circuit to turn on the electromagnet 15 and cause the magnet M to be securely held against the main body portion 2. The electromagnet 15 is shown having as bottom wall thereof seated on top of the upper surface of the main body portion 2 of the magnet positioning apparatus 1. In an upper surface of the electromagnet 15, there is a recess 18 in which the battery 16 is fitted. The battery 16 has positive and negative terminals which are connected by means of wires to positive and negative terminals of the electromagnet 15. The electromagnet 15 also includes an angle indicator I seated on the upper surface thereof. The switch 17 is preferably a double-pole, double-throw type switch in order to be able to easily change the polarity of the electromagnet 15.

Figure 6:
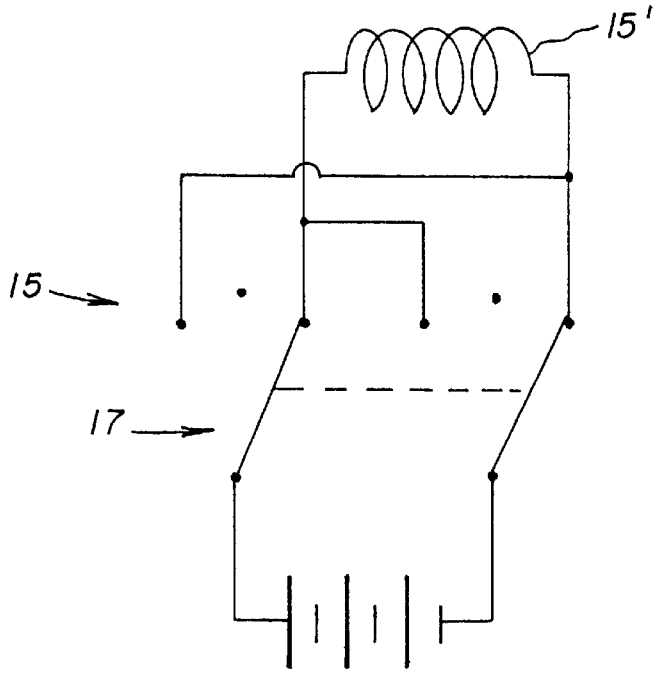
FIG. 6 is an electric circuit diagram showing a double-pole double-throw switch for use with an electromagnet magnet holding members of FIGS. 4, 11, and 12.

Referring to FIG. 6, a schematic diagram of the electrical circuit of the double-pole, double-throw switch 17 of the electromagnet 15 is shown in a position closing the circuits to the right, providing one polarity to coil 15' of electromagnet 15. When switch 17 is closed toward the left, the opposite polarity is provided to coil 15'. An intermediate position of the switch simply leaves an open circuit.

The electromagnet 15 of the magnet positioning apparatus 1 may include a magnetic ferrous core so that the magnet M is or the magnets $M_1$–$M_n$ are held in contact against the main body portion 2 in two situations. First, the magnet M is or the magnets $M_1$–$M_n$ are held in contact against the main body portion 2 when the electromagnet 15 is deenergized. Second, the magnet M is or the magnets $M_1$–$M_n$ are held in contact against the main body portion 2 when the electromagnet 15 is energized with the polarity of the electromagnet 15 being opposite of the polarity of the magnet M or magnets $M_1$–$M_n$ to be released into the subsurface region. Thus, the magnet M is or the magnets $M_1$–$M_n$ are released from contact with the main body portion 2 when the electromagnet 15 is energized with the polarity of the electromagnet 15 being the same as the polarity of the magnet M or magnets $M_1$–$M_n$ to be released into the subsurface region.

The electromagnet 15 of the magnet positioning apparatus 1 may also includes a non-magnetic, non-ferrous core (such as, for example, air, plastic, paper, aluminum, etc.) so that the magnet M is or the magnets $M_1$–$M_n$ are held in contact against the main body portion 2 only when the electromagnet 15 is energized with the polarity of the electromagnet 15 being opposite of the polarity of the magnet M or the magnets $M_1$–$M_n$ to be released into the subsurface region. Thus, the magnet M is or the magnets $M_1$–$M_n$ are released from contact with the main body portion 2 when the electromagnet 15 is deenergized and also when the electromagnetic 15 is energized with the polarity of the electromagnet 15 being the same as the polarity of the magnet M or the magnets $M_1$–$M_n$ to be released into the subsurface region.

Figure 7:
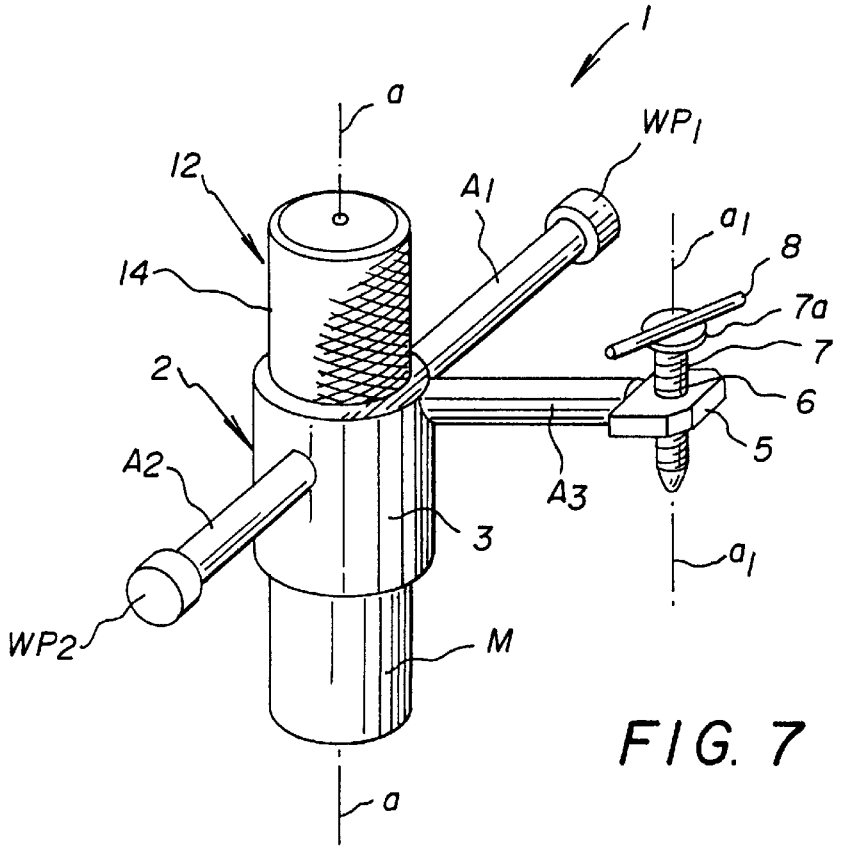
FIG. 7 is a perspective view of the first embodiment of the magnet positioning apparatus of the present invention of FIG. 1 shown in a state of releasably securing one magnet to the lower surface of the main body portion.
Figure 8:
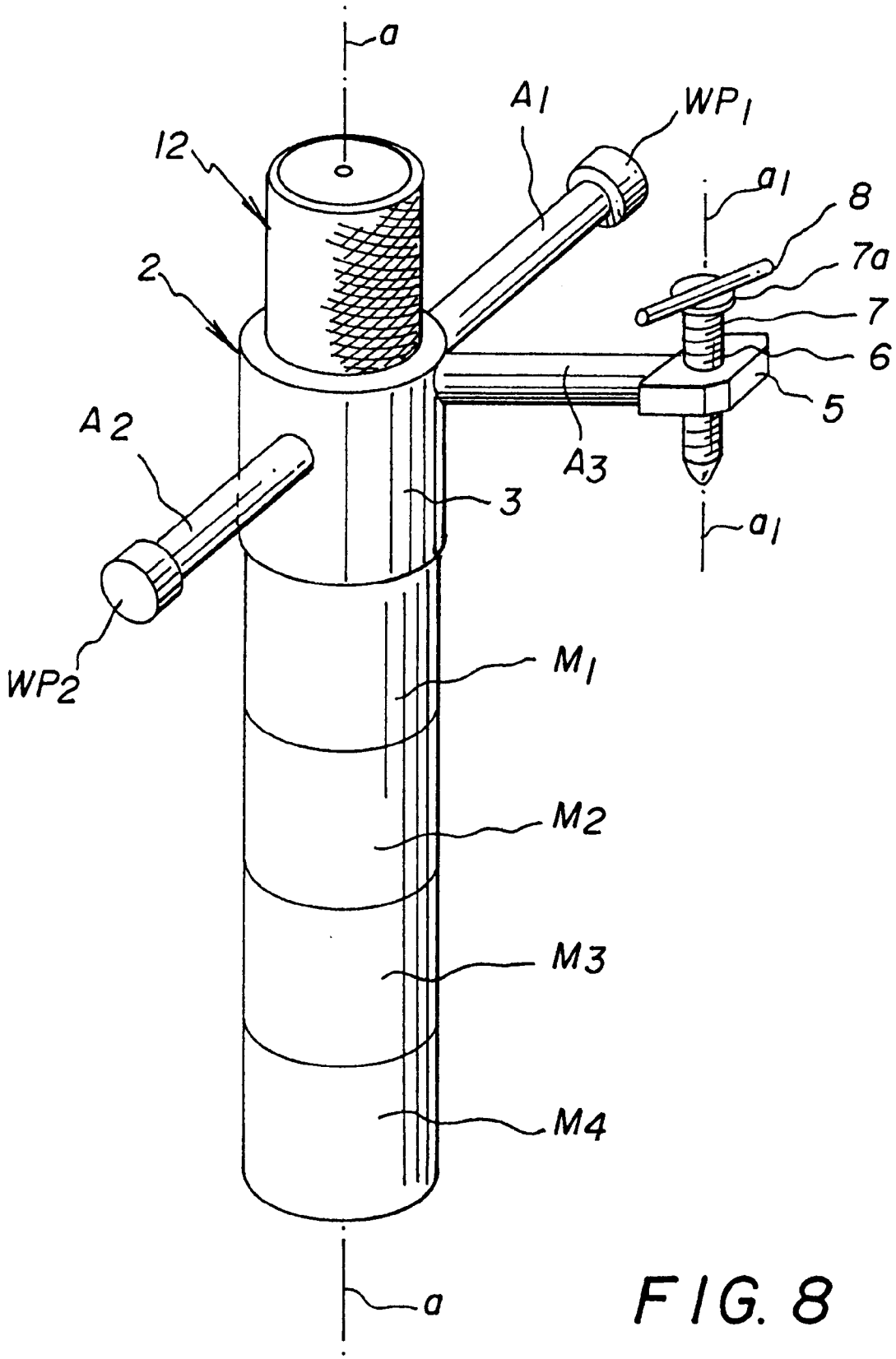
FIG. 8 is a perspective view of the first embodiment of the magnet positioning apparatus of the present invention of FIG. 1 shown in a state of releasably securing four contiguous magnets to the lower surface of the main body portion.

Referring to FIG. 7, the use of the magnet positioning apparatus 1 for precisely positioning a magnet M in a road surface RS is shown. In a road surface RS where the pavement thickness is relatively thin, a single magnet M (most likely a very strong magnet made from rare earth materials, which is hereinafter referred to simply as a "rare earth magnet") is installed. A single magnet M could be positioned in each hole H drilled in the road surface RS. However, rare earth magnets are very expensive so that sometimes it is preferable to use a plurality of magnets made of ceramic materials (hereinafter called "ceramic magnets") rather than the single rare earth magnet. In FIG. 8, the magnet positioning apparatus 1 is shown having four magnets $M_1$–$M_4$ which are situated contiguous to each other and are releasably secured to a lower surface of the main body portion 2. For example, if a pavement a road surface RS is sufficiently thick, it is more economical to use a plurality of the less expensive ceramic magnets. Conversely, if the road surface RS is relatively thin, it may be best to use a single rare earth magnet.

Figure 9:
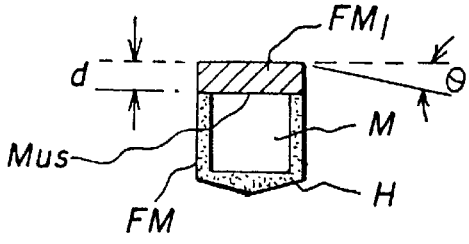
FIG. 9 is a cross-sectional view showing the one magnet of FIG. 7 after the magnet has been positioned through a hole into a subsurface region beneath a road surface.
Figure 10:
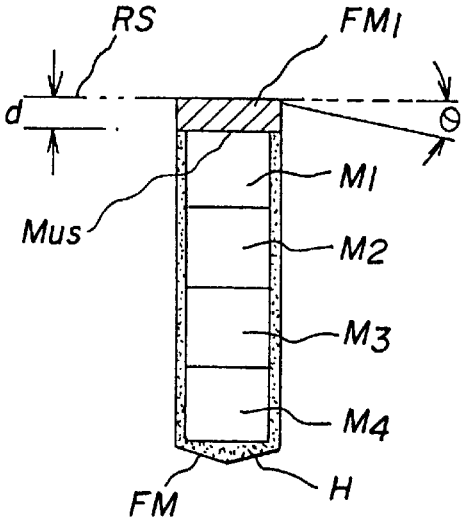
FIG. 10 is a cross-sectional view of the four magnets of FIG. 8 after the magnets have been positioned through a hole into a subsurface region beneath a road surface.

FIGS. 9 and 10 illustrate cross-sections through holes H wherein either a single magnet M, such as a rare earth magnet, or four magnets $M_1$–$M_4$, such as ceramic magnets, have been positioned in the holes H with the use of the magnet positioning apparatus 1, respectively. It should be noted that both the single magnet M, such as a rare earth magnet, and the four contiguous magnets $M_1$–$M_4$, such as ceramic magnets, are positioned within the holes H so that there is only slight clearance between the lower surface of the magnet M and the bottom of the hole H and the sides of the magnet M or magnets $M_1$–$M_4$ and the sides of the hole H. This clearance may be filled with any type of filler material FM such as sand, glue or other filler material. The filler material FM does not necessarily have to be poured through an access hole or clearance, but rather may be placed around the magnet M as the magnet is positioned through the hole H and into the subsurface region.

After the magnet M or magnets $M_1$–$M_4$ are positioned in the subsurface region and the magnet positioning apparatus 1 is removed, a clearance may exist between the upper surface $M_{us}$ of the magnet M and the top of the hole H, the top of the hole H being level with the road surface RS. The clearance is depicted by diagonal lines which represents a non-magnetic filler material $FM_1$ which has been placed over the upper surface $M_{us}$ of the magnet M to close the hole H. The non-magnetic filler material $FM_1$ may be, for example, epoxy, grout or other similar material.

Referring to FIG. 11, a theoretical illustration of a magnet positioning apparatus 1 is shown for positioning a magnet through a hole and at a predetermined height and angle relative to a surface. The magnet positioning apparatus 1 includes a main body portion 2, which in this embodiment takes on the form of a flat plate representing the base plane, equivalent to the lower surface of the hollow cylindrical member 3 of the previous embodiment. The main body portion 2 has attached thereto, a plurality of arms $A_1$–$A_n$ which may be adjustable with respect to the main body portion 2. In this theoretical illustration, the magnet positioning apparatus 1 for positioning a magnet in a surface has four arms $A_1$–$A_4$ which are located at the corners of the plate-like main body portion 2. The arms $A_1$–$A_4$ rest on the surface and support the plate-like main body portion 2 over the hole in the surface. The arms $A_1$–$A_4$ may be adjustable to provide a desired orientation to the body portion 2.

The member 12 for releasably securing the magnet M to the main body portion 2 may be made of magnetic material and is shown as being cylindrically shaped in FIG. 11. However, any shape to accomplish the function of releasably securing the magnet M to the main body portion 2 may be used.

Alternatively, the member 12 for releasably securing the magnet M to the main body portion 2 may be an electromagnet 15 having a switch 17 connected to a battery 16. The switch 17 is preferably a double-pole, double-throw switch to easily change the polarity of the electromagnet 15.

A plurality of access holes 20 are shown through the plate-like main body portion 2 for pouring filler material FM into the hole H once the magnet M is positioned in the predetermined position. The access holes 20 are shown as being arch-shaped in FIG. 11. However, the access holes 20 may be of any shape to accomplish the function of allowing filler material FM into the subsurface region to fix the magnet M in place once correctly positioned therein. The access holes 20 may not even be used in a situation where the filler material FM, such as an epoxy, may already be positioned in the hole H and the magnet M is then submerged into the epoxy.

The second embodiment of the magnet positioning apparatus 1 for use in positioning a magnet M in a surface also shows a combination angular indicator I and leveling member 19. The angular indicator I and leveling member 19, like the bullseye level of the previous embodiment, may only be necessary in cases where positioning of the magnet requires higher accuracy of the angle θ. When the angular indicator I and leveling member 19 is employed, it can either be positioned on the main body portion 2 as shown in FIG. 11 or alternatively and not illustrated, on the member 12 for releasably securing the magnet M to the main body portion 2.

The angular indicator I and leveling member 19 includes a plate-like member 21 adjustably supported on a plurality of legs $L_1$–$L_n$. The combination angular indicator I and leveling member 19 also includes two bubble levels for two directional leveling.

Figure 12:
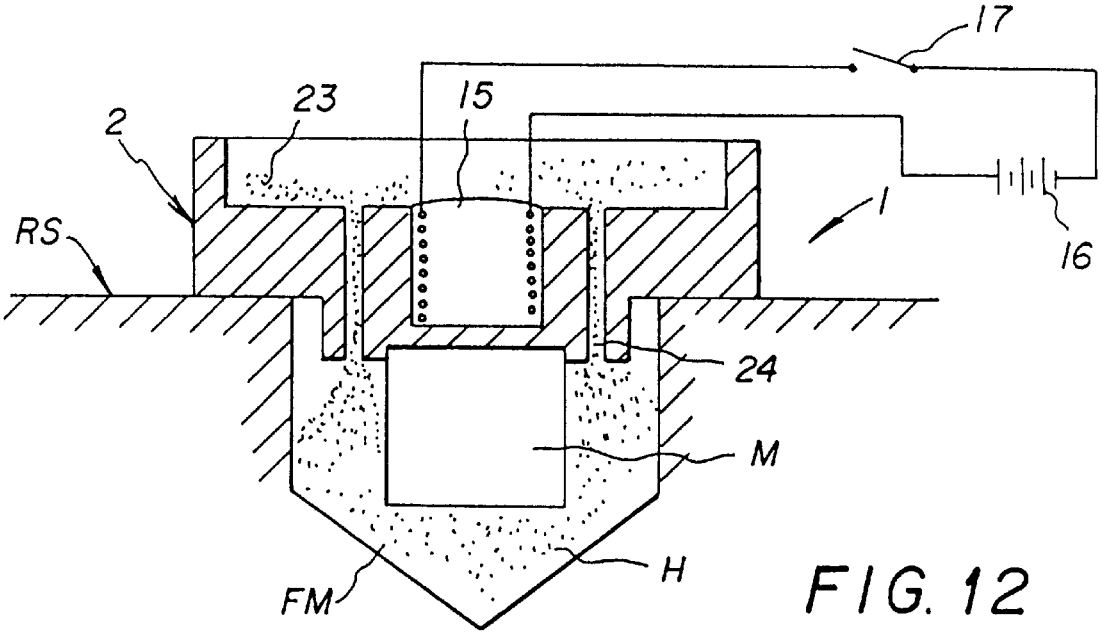
FIG. 12 is a side elevational view of a third embodiment of the magnet positioning apparatus of the present invention positioned over a hole in road surface into which a magnet is to be positioned.

Referring to FIG. 12, a third embodiment of a magnet positioning apparatus 1 for positioning a magnet M through a hole H into a subsurface region beneath a road surface RS is shown. The magnet positioning apparatus 1 includes a main body portion 2 having a filler material reservoir 23 therein. The main body portion 2 of the third embodiment of the magnet positioning apparatus 1 also has a plurality of through-holes 24 leading from a bottom surface of the filler material reservoir 23 to the subsurface region for allowing the filler material FM to pass from the reservoir 23 to the subsurface region once the magnet M has been correctly positioned in the subsurface region. The third embodiment of the magnet positioning apparatus 1 includes an electromagnet 15 as the member 12 for releasably securing the magnet M to the main body portion 2.

The electromagnet 15 includes a switch 17 which is preferably a double-pole, double-throw switch for easily changing polarity and a battery 16 for energizing the electromagnet 15 in order to hold the magnet M against the main body portion 2 prior to releasing the correctly positioned magnet M in the subsurface region.

Referring to FIG. 13, a magnet positioning apparatus 1' is shown for use in positioning a magnet M through a hole H in a cabinet surface CS in order for the magnet M to either hold hardware to the cabinet surface CS, such as door or drawer, etc., or to hold the cabinet door or drawer closed due to magnetic attraction. The magnet positioning apparatus 1' is shown as block-shaped, however, any shape can be used which will allow the function of positioning the magnet M through a hole H in the cabinet surface CS to a subsurface region beneath the cabinet surface CS.

Referring to FIG. 14, a magnet positioning apparatus 1" is shown for use in positioning a magnet M through a hole H in a curved surface C'S. The magnet positioning apparatus 1" is shown as block-shaped with a curved lower surface complementarily corresponding to the shape of the curved surface C'S in which the magnet M is to be positioned. However, any shape can be used which will allow the function of positioning the magnet M through a hole H in the curved surface C'S to a subsurface region beneath the curved surface C'S. FIG. 14 also particularly shows that the magnet M is positioned in the subsurface region with an adhesive filler material FM therearound in order to fix the magnet in the subsurface region beneath the curved surface C'S.

In operation, the magnet positioning apparatus 1, 1' or 1" is placed over the hole H so that the magnet M or magnets $M_1$–$M_n$ are within the hole H and the means for supporting or the arms $A_1$–$A_3$ are resting on the surface RS, CS, or C'S of the substrate. In order to position the magnet M or magnets $M_1$–$M_n$ at a predetermined angle θ to and predetermined distance d from the road surface RS, the cabinet surface CS, or the curved surface C'S adjacent to the hole H. The main body portion 2 is fabricated to achieve roughly the angle θ and the distance d. The precise final adjustment is performed when the adjustment member 4 is adjusted.

In the case of the magnet positioning apparatus 1 for a road surface RS, the screw or screws 7 in the adjustment member or members 4 attached to the second ends of either one or two of the three arms $A_1$, $A_2$, and $A_3$ are turned until a bubble of the bullseye level (angle indicator I) is located within a etched circle on the window of the bullseye level. When the bubble is correctly positioned with respect to the circle etched on the window of the bullseye level the clearances between the bottom and sides of the magnet M or magnets $M_1$–$M_n$ and the hole H are backfilled with filler material FM and the member 12 for releasably securing the magnet M against the main body portion 2 is withdrawn from the hollow cylindrical member 3 or the electromagnetic 15 is turned off, thereby releasing the magnet M from its securement against the main body portion 2 so that the magnet M or magnets $M_1$–$M_n$ remain in their correct position within the subsurface region.

A magnet positioning apparatus 1 for precisely positioning a magnet M or magnets $M_1$–$M_n$ in a road surface RS was tested in use on a road surface RS. The magnet positioning apparatus 1 which was made included a main body portion 2 made of aluminum. The outer diameter of the hollow cylindrical member 3 of the main body portion 2 of the magnet positioning apparatus 1 that was made was 25.4 mm and the inner diameter was 13 mm. Three holes approximately 4.7 mm in diameter were formed in the side wall of the hollow cylindrical member 3. Two of the three holes were formed so that the center lines of the holes were 15 mm from the bottom surface of the hollow cylindrical member 3. The third of the three holes was formed so that the centerline of the of the hole was 20 mm from the bottom surface of the hollow cylindrical member 3. It should be noted that these dimensions are used to obtain a distance d equal to 9 mm for ceramic magnets and 10 mm for rare earth magnets.

A typical arm A was approximately 30 mm long from end to end having a 5 mm front portion for fitting into a hole in the hollow cylindrical member 3, a 20 mm intermediate portion, and a 5 mm widened portion WP. The widened portion WP was approximately 9.5 mm in diameter, the intermediate portion was approximately 5.5 mm in diameter and the front portion was approximately 4.76 mm in diameter. However, the arm $A_3$ built to have widened portions WP with screws therethrough for angle adjustment and leveling purposes were manufactured to be 37 mm from end to end with a 5 mm front portion for fitting into the holes in the hollow cylindrical member 3, a 22 mm intermediate portion, and a 10 mm long widened portion WP which had a threaded hole therethrough. The widened portion WP in this case had a width of 9.5 mm and a thickness of approximately 2.75 mm.

The screw 7, M5×25, for the threaded hole 6, had a pointed end of an approximately 60 degree angle. To the head of the screw 7 was braze welded an approximately 2.3 mm diameter steel rod-shaped member 8 which was approximately 20 mm long.

The member 12 for releasably securing a magnet M to the main body portion 2 was manufactured so that the outer diameter of the grasping portion 14 was approximately 19 mm in diameter and approximately 20 mm long. The magnetic portion 13 was approximately 12.7 mm in diameter with a 6.3 mm diameter bore drilled therein and was approximately 25 mm long.

The size of the magnets M held by the member 12 for releasably securing the magnet M to the main body portion 2 and placed through a hole H in to the subsurface region beneath the road surface RS depended on whether the magnet M was a rare earth magnet or one of a plurality of ceramic magnets. For positioning a rare earth magnet, the member 12 for releasably securing the magnet M to the main body portion 2 held a single magnet M which was 26 mm in diameter and 26 mm deep. However, for positioning a plurality of ceramic magnets, the magnet holder 19 held four contiguous magnets $M_1$, $M_2$, $M_3$ and $M_4$ end to end with each of the magnets $M_1$, $M_2$, $M_3$ and $M_4$ being 23 mm in diameter and 26 mm high. Thus, the typical hole H into which a single magnet M, such as a rare earth magnet, was positioned was between 32 mm to 37 mm in diameter and 33 mm to 38 mm deep, whereas the typical hole H into which the four contiguous magnets $M_1$, $M_2$, $M_3$ and $M_4$, such as ceramic magnets, were positioned was between 29 mm to 35 mm in diameter and approximately 111 mm deep. Of course, any size of magnet M and corresponding hole H may be employed with the present invention.

The form of the invention shown and described in this disclosure represents an illustrative embodiment thereof only and it is understood that various changes may be made without departing from the spirit and scope of the present invention as further defined by the claimed subject matter as follows.

I claim:

1. A magnetic positioning apparatus, comprising:

a main body portion of a non-magnetic material;

means for releasably securing at least one magnet to said main body portion; and means for supporting said main body over a hole in a surface leading to a subsurface region in which said at least one magnet is to be positioned so as to position a top surface of said at least one magnet in said hole at a predetermined angle to and a predetermined distance from said surface adjacent to said hole, wherein said main body portion includes adjustment means for adjusting said main body portion with respect to said hole in said surface, wherein said means for releasably securing said at least one magnet to said main body portion is an electromagnet including a switch connecting said electromagnet to a battery.

2. The magnetic positioning apparatus of claim 1, wherein said switch is a double-pole double-throw switch for changing polarity of said electromagnet.

3. The magnet positioning apparatus of claim 2, wherein said electromagnet includes a magnetic ferrous core so that said at least one magnet is held in contact against said main body portion both when said electromagnet is deenergized and when said electromagnet is energized said at least one magnet is released into said subsurface region.

4. The magnet positioning apparatus of claim 2, wherein said electromagnet includes a non-magnetic, non-ferrous core so that said at least one magnet is held in contact against said main body portion only when said electromagnet is energized, and so that said at least one magnet is released from contact with said main body portion when said electromagnet is deenergized.

5. The magnet positioning apparatus of claim 1 wherein said main body portion is a plate having a lower surface conforming to a shape of said surface containing said hole through which said at least one magnet is to be positioned and said adjustment means includes at least one leg adjustably connected to said main body portion.

6. The magnet positioning apparatus of claim 5, wherein said main body portion also has at least one access hole therein for backfilling of a filler material into said hole after said at least one magnet has been positioned in said subsurface region beneath said hole to keep said at least one magnet fixed once correctly positioned with respect to angle and distance.

7. The magnet positioning apparatus of claim 1, wherein said main body portion has a recess therein for holding filler material and through-holes leading from said recess to allow said filler material in said recess to pass through said main body portion into said hole to surround said at least one magnet once said magnet has been properly positioned in said hole.

* * * * *